US011200876B2

(12) United States Patent
Kemmerer et al.

(10) Patent No.: US 11,200,876 B2
(45) Date of Patent: Dec. 14, 2021

(54) ACTIVITY-BASED SMART TRANSPARENCY

(71) Applicant: BOSE CORPORATION, Framingham, MA (US)

(72) Inventors: Jeremy Kemmerer, Holliston, MA (US); Juan Carlos Rodero Sales, Boston, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/931,659

(22) Filed: May 14, 2020

(65) Prior Publication Data

US 2021/0358470 A1 Nov. 18, 2021

(51) Int. Cl.
*G10K 11/175* (2006.01)
*H04S 7/00* (2006.01)

(52) U.S. Cl.
CPC ..... *G10K 11/1752* (2020.05); *H04S 7/304* (2013.01); *H04S 2400/13* (2013.01)

(58) Field of Classification Search
CPC . H04S 7/00; H04S 7/302; H04S 7/303; H04S 7/304; H04S 2400/13; H04R 5/04; H04R 2225/43; H04R 2225/41; H04R 2460/01; H04R 2460/07; G10K 11/175; G10K 11/1752; G10K 2210/108; G10K 2210/1081; G10K 2210/1082
See application file for complete search history.

(56) References Cited

U.S. PATENT DOCUMENTS 10,636,405 B1 4/2020 Kemmerer
2010/0246846 A1 9/2010 Burge et al.
2015/0139458 A1 5/2015 Ruwe et al.
2015/0181338 A1* 6/2015 Hosoi ..... H04M 1/03 381/309
2015/0230036 A1* 8/2015 Pedersen ..... H04R 25/305 381/330
2016/0140947 A1 5/2016 Hamalainen
2017/0061951 A1* 3/2017 Starobin ..... G10K 11/1783
2017/0257723 A1* 9/2017 Morishita ..... H04R 5/033
2017/0374477 A1* 12/2017 Salvatucci ..... H04R 25/505
2018/0123813 A1 5/2018 Milevski et al.
2018/0286374 A1* 10/2018 Cattell ..... G10K 11/17881
2019/0028803 A1* 1/2019 Benattar ..... H04R 1/406
2019/0116434 A1* 4/2019 Fretz ..... H04R 25/43
2019/0361666 A1* 11/2019 Oide ..... G06F 3/165
2020/0145757 A1* 5/2020 Kraemer ..... H04R 5/04
2020/0236466 A1* 7/2020 Zhao ..... G06F 3/017

OTHER PUBLICATIONS

International Search Report and Written Opinion for International Application No. PCT/US2021/026542 dated Jul. 15, 2021.

* cited by examiner

*Primary Examiner* — Walter F Briney, III

(74) *Attorney, Agent, or Firm* — Patterson + Sheridan, LLP

(57) ABSTRACT

A method performed by a head-mounted wearable audio output device is provided. The audio output device is worn on a head of a user and includes at least one sensor. The device detects a user activity based on motion of the user's body using the at least one sensor. The devices detects an orientation of the head of the user is one of upward or downward using the at least one sensor. The devices controls at least one of: a level of attenuation applied to external noise or audio output based on the detected user activity and the detected orientation of the head of the user.

22 Claims, 2 Drawing Sheets

ACTIVITY-BASED SMART TRANSPARENCY

FIELD

Aspects of the disclosure generally relate to controlling a head-mounted wearable audio output device based, at least in part, on both a detected user activity and detected head orientation of the user wearing the audio output device.

BACKGROUND

People wear headphones as they switch between various activities. Oftentimes, people make adjustments related to audio output as they move between activities. Active noise reduction (ANR) (sometimes referred to as active noise canceling (ANC) or controllable noise canceling (CNC)) attenuates a varying amount of sounds external to the headphones. ANR is but one feature that provides a more immersive listening experience. A user may desire different levels of immersion based on their activity and/or location. For instance, there may be certain situations when a user wearing the headphones with ANR turned on may want to or need to hear certain external sounds for more situational awareness. On the other hand, there may be situations when the user may want the ANR to be set to a high level to attenuate most external sounds. ANR audio output devices allow the user to manually turn on or turn off ANR, or even set a level of ANR. However, adjusting the audio output and/or ANR is made by toggling through various interfaces on the headphones and/or a personal user device in communication with the headphones. This takes effort and may be cumbersome for the user. A need exists for improving how audio output devices adjust ANR and other features of a wearable audio output device.

SUMMARY

All examples and features mentioned herein can be combined in any technically possible manner.

Aspects of the present disclosure provide methods, apparatus, and computer-readable mediums having instructions stored in memory which, when executed, cause a head-mounted wearable audio output device to automatically control an audio output of the device based, in part, on both a detected user activity and detected head orientation of the user wearing the device.

Aspects of the present disclosure provide a method performed by a head-mounted wearable audio output device, comprising at least one sensor, that is worn on a head of a user for controlling reproduction of external noise or audio output, comprising detecting a user activity based on motion of the user's body using the at least one sensor, detecting an orientation of the head of the user is one of upward or downward using the at least one sensor, and controlling at least one of: a level of attenuation applied to the external noise or the audio output based on the detected user activity and the detected orientation of the head of the user.

In aspects, detecting the user activity comprises detecting a change from a first detected activity of a set of activities to a second detected activity of the set of activities, wherein the set of activities comprises any combination of: walking, running, sitting, standing, or moving in a mode of transport.

In aspects, the at least one sensor comprises an accelerometer. Detecting the user activity comprises one of: detecting the user activity based on energy levels of signals detected by the accelerometer or detecting the user activity based on a classifier model trained using training data of known accelerometer signals associated with each activity in the set of activities.

In aspects, detecting the change comprises determining when the user changes from sitting to walking and the controlling comprises reducing the level of attenuation to enable the user to hear more of the external noise. In aspects, the method further comprises determining the user changes from walking to back to sitting and increasing the level of attenuation to attenuate an increased amount of the external noise. In aspects, increasing the level of attenuation is based on input from the user.

In aspects, the user activity comprises one of walking or running, the orientation of the head comprises the downward orientation, and the controlling comprises reducing the level of attenuation applied to the reproduction of external noise or adjusting the audio output by lowering a volume of the audio output.

In aspects, the method further comprises determining an audio mode, wherein each audio mode of a set of audio modes invokes a set of behaviors by the wearable audio output device, wherein the controlling is further based on the determined audio mode.

In aspects, the wearable audio output device is configured to perform Active Noise Reduction (ANR).

Certain aspects provide a head-mounted wearable audio output device for controlling reproduction of external noise or audio output, comprising: at least one sensor on the wearable audio output device; and at least one processor coupled to the at least one sensor, the at least one processor configured to: detect a user activity based on motion of the user's body using the at least one sensor when the wearable audio output device is worn on a head of a user, detect an orientation of the head of the user is one of upward or downward using the at least one sensor, and control at least one of: a level of attenuation applied to the external noise or the audio output based on the detected user activity and the detected orientation of the head of the user.

In aspects, the at least one processor detects the user activity by detecting a change from a first detected activity of a set of activities to a second detected activity of the set of activities, wherein the set of activities comprises any combination of: walking, running, sitting, standing, or moving in a mode of transport.

In aspects, detecting the change comprises determining the user changes from sitting to walking and the at least one processor controls by reducing the level of attenuation to enable the user to hear more of the external noise.

In aspects, the at least one processor is further configured to determine the user changes from walking to back to sitting and increase the level of attenuation to attenuate an increased amount of the external noise.

In aspects, the at least one processor increases the level of attenuation based on input from the user.

In aspects, the user activity comprises one of walking or running, the orientation of the head comprises the downward orientation, and the at least one processor controls by reducing the level of attenuation applied to the external noise or adjusting the audio output by lowering a volume of the audio output.

In aspects, the at least one processor is further configured to determine an audio mode, wherein each audio mode of a set of audio modes invokes a set of behaviors by the head-mounted wearable audio output device, wherein the at least one processor controls based on the determined audio mode.

Certain aspects provide a head-mounted wearable audio output device worn by a user for controlling reproduction of external noise or audio output, comprising: an accelerometer, at least one acoustic transducer for outputting audio, and at least one processor configured to: detect a user activity based on motion of the user's body using the accelerometer when the wearable audio output device is worn on a head of the user, detect an orientation of the head of the user is one of upward or downward using the accelerometer, and control at least one of: a level of attenuation applied to the external noise or the audio output based on the detected user activity and the detected orientation of the head of the user.

In aspects, the head-mounted wearable audio output device comprises noise masking circuitry for generating masking sounds and the at least one processor is configured to adjust the audio output by adjusting one of a content or volume of noise masking based on the detected user activity and the detected orientation of the head of the user.

In aspects, the at least one processor detects the user activity by detecting a change from a first detected activity of a set of activities to a second detected activity of the set of activities. The set of activities comprises any combination of: walking, running, sitting, standing, or moving in a mode of transport, detecting the change comprises determining the user changes from sitting to walking, and the at least one processor controls by reducing the level of attenuation to enable the user to hear more of the external noise.

In aspects, the at least one processor is further configured to determine an audio mode, wherein each audio mode of a set of audio modes invokes a set of behaviors by the head-mounted wearable audio output device, wherein the at least one processor controls based on the determined audio mode.

Two or more features described in this disclosure, including those described in this summary section, may be combined to form implementations not specifically described herein. The details of one or more implementations are set forth in the accompanying drawings and the description below. Other features, objects and advantages will be apparent from the description and drawings, and from the claims.

DETAILED DESCRIPTION

Figure 1:
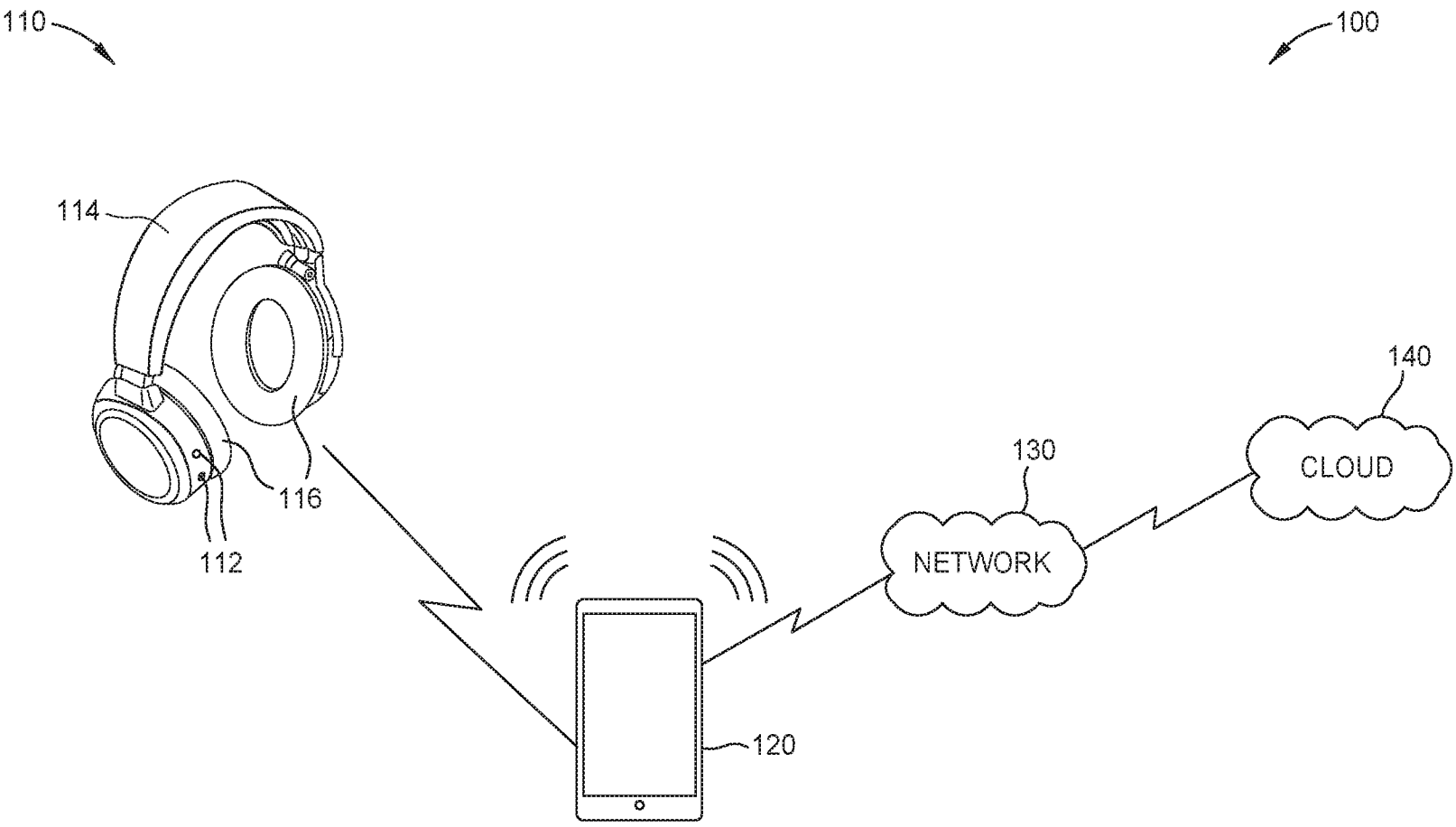
FIG. 1 illustrates an example system in which aspects of the present disclosure may be practiced.

Modern day headphones have functionalities that go far beyond simply allowing a user to listen to a stream of audio. As described above, through ANR, ANC and/or CNC, headphones block out external noise heard by a user. Some headphones wirelessly communicate with personal user devices such as cell phones, smart wearables, tablets, and computers. Headphones stream audio from a connected personal user device, provide audio notifications associated with a program or application running on the personal user device, and enable a user to answer phone calls and conduct teleconferences via the connection with the personal user device.

In an example scenario, a user wearing a head-mounted audio output device desires to block out some amount of external noise. Noise canceling features on the device may be set to high to attenuate external noise, for example, to help the user focus on a task. The user removes the headphones when they desire increased situational awareness. In one example, the user removes the headphones as they stand up and begin walking. In another example, the user removes the headphones when they look up and begin speaking to a colleague.

Instead of removing the headphones or manually adjusting the audio output by interacting with the headphones or an application running on a personal user device, aspects provide methods for intelligently controlling the audio output based on information collected using at least one sensor mounted on a head-mounted audio output device. In aspects, the at least one sensor is an accelerometer, magnetometer, gyroscope, or an inertial measurement unit (IMU) including a combination of an accelerometer, magnetometer, and gyroscope.

Head-mounted audio output devices described herein intelligently adjust audio output and functionalities of the device based on the activity performed by the user. In certain aspects, the user may desire that the audio output is continually adjusted in real time based on the user's activity. In certain aspects the user may desire the audio output to be adjusted based on both the user's activity and orientation (e.g., position) of the user's head.

Based on the detected user activity and/or orientation of the user's head, aspects of the present disclosure provide methods for smart (automatic), activity-based control of audio output by a head-mounted audio output device. As used herein, control of audio output refers to controlling the reproduction of external noise, controlling audio output, or a combination of controlling the reproduction of external noise and controlling the audio output. In some examples, the reproduction of external noise is controlled by adjusting a level of attenuation to enable to user to hear more or less of the external noise. Head-mounted wearable audio output devices capable of ANR, ANC, and/or CNC are configured to adjust the level of attenuation, allowing the user to hear a varying amount of external noise while wearing the device. In some examples, controlling the audio output refers to adjusting a volume of audio output played by the device, changing a feature of the audio stream, or changing a type of audio that is output by the device.

FIG. 1 illustrates an example system 100 in which aspects of the present disclosure may be practiced.

As shown, system 100 includes a head-mounted wearable audio output device (a pair headphones) 110 communicatively coupled with a personal user device 120. In an aspect, the headphones 110 may include one or more microphones 112 to detect sound in the vicinity of the headphones 110 and, consequently, the user. The headphones 110 also include at least one acoustic transducer (not illustrated, also known as driver or speaker) for outputting sound. The acoustic transducer(s) may be configured to transmit audio through air and/or through bone (e.g., via bone conduction, such as through the bones of the skull).

The headphones 110 include at least one sensor for detecting one or more of head movement, body movement, and head orientation of a user wearing the headphones 110. In an example, the at least one sensor is located on the headband portion 114 which connects the ear cups 116. In an aspect, the at least one sensor is an accelerometer or IMU. Based on information collected using the at least one sensor, the headphones or a device in communication with the headphones determines the user's activity. Non-limiting examples of user activities include the user sitting, standing, walking, running, or moving in a mode of transport. Additionally, based on information collected using the at least one sensor, the headphones or a device in communication with the headphones determines the orientation of a user's head (the head position) wearing the headphones. Non-limiting examples of head-orientation include the user's head being oriented in an upward direction or downward direction.

In aspects, the headphones 110 includes hardware and circuitry including processor(s)/processing system and memory configured to implement one or more sound management capabilities or other capabilities including, but not limited to, noise cancelling circuitry (not shown) and/or noise masking circuitry (not shown), geolocation circuitry, and other sound processing circuitry. The noise cancelling circuitry is configured to reduce unwanted ambient sounds external to the headphones 110 by using active noise cancelling. The noise masking circuitry is configured to reduce distractions by playing masking sounds via the speakers of the headphones 110. The geolocation circuitry may be configured to detect a physical location of the user wearing the headphones. For example, the geolocation circuitry includes Global Positioning System (GPS) antenna and related circuitry to determine GPS coordinates of the user.

In an aspect, the headphones 110 are wirelessly connected to a personal user device 120 using one or more wireless communication methods including but not limited to Bluetooth, Wi-Fi, Bluetooth Low Energy (BLE), other radio frequency (RF)-based techniques, or the like. In an aspect, the headphones 110 includes a transceiver that transmits and receives information via one or more antennae to exchange information with the user device 120.

In aspects, the headphones 110 may be connected to the personal user device 120 using a wired connection, with or without a corresponding wireless connection. As shown, the user device 120 may be connected to a network 130 (e.g., the Internet) and may access one or more services over the network 130. As shown, these services may include one or more cloud services 140.

The personal user device 120 is representative of any computing device, including cell phones, smart wearables, tablets, and computers. In an aspect, the personal user device 120 accesses a cloud server in the cloud 140 over the network 130 using a mobile web browser or a local software application or "app" executed on the personal user device 120. In an aspect, the software application or "app" is a local application that is installed and runs locally on the personal user device 120. In an aspect, a cloud server accessible on the cloud 140 includes one or more cloud applications that are run on the cloud server. The cloud application may be accessed and run by the personal user device 120. For example, the cloud application may generate web pages that are rendered by the mobile web browser on the personal user device 120. In an aspect, a mobile software application installed on the personal user device 120 and a cloud application installed on a cloud server, individually or in combination, may be used to implement the techniques for determining a user activity and determining a head orientation of a user wearing the headphones 110 in accordance with aspects of the present disclosure.

FIG. 1 illustrates over-the-ear-headphones 110 that control reproduction of external noise or audio output for exemplary purposes. Any head-mounted wearable audio output device with similar acoustic capabilities may be used to control reproduction of external noise or audio output. As an example, headphones 110 may be used interchangeably with hook earbuds having an around the-ear-hook including acoustic driver module that sits above the user's ear and a hook portion that curves around the back of the user's ear. In another example, headphones 110 may be used interchangeably with audio eyeglass "frames." Both the hook earbuds and frames have at least one sensor that is used to determine user activity and head orientation as described with reference to the headphones 110.

Figure 2:
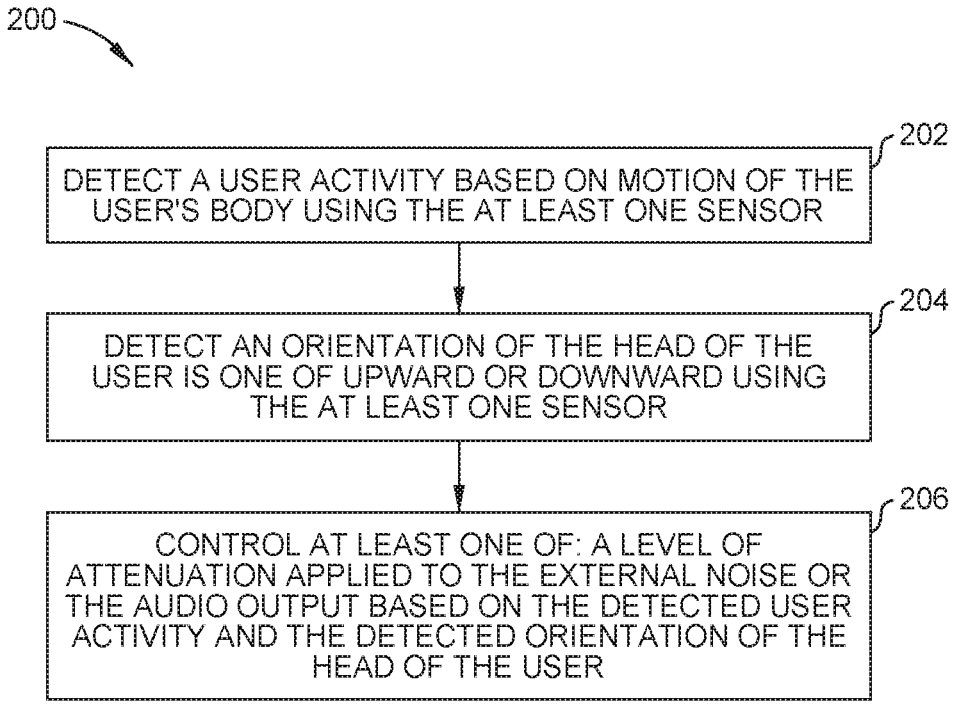
FIG. 2 illustrates example operations performed by a head-mounted wearable audio output device worn by a user for controlling external noise, in accordance with certain aspects of the present disclosure.

FIG. 2 illustrates example operations 200 performed by a head-mounted wearable audio output device (e.g., headphones 110 as shown in FIG. 1) worn by a user for controlling the reproduction of external noise or audio output in accordance with certain aspects of the present disclosure. The head-mounted wearable audio output device includes at least one sensor for detecting a user activity and head orientation of the user wearing the device.

At 202, the audio output device detects a user activity based on motion of the user's body using the at least one sensor. Examples of user activity include sitting, standing, walking, running, moving in a mode of transport (e.g., car, train, bus, airplane), walking or otherwise moving up stairs, walking or otherwise moving down stairs, and engaging in repetitive exercises such as push-ups, pull-ups, sit-ups, lunges, and squats.

As the sensor is continuously collecting information to determine the user's activity, in aspects, the audio output device detects a change from a first activity to a second activity. In an example, an accelerometer or IMU (including an accelerometer) determines the acceleration of the user based on energy levels of detected accelerometer signals. In aspects, the energy levels of the signals are detected in one or more of the x, y, and z directions. The detected acceleration is used to determine the user's activity or a change from a first activity to a second activity. In aspects, outputs from multiple sensors are combined to determined, with increased accuracy, the user activity. In another example, a classifier model is trained using training data of known accelerometer signal energies associated with each of the activities. Signal collected using the at least one sensor on-board the device are input into the trained classifier model to determine the user's activity or a change from a first activity to a second activity. The algorithm used to determine the user's activity is executed on the audio output device, an app executed on a personal user device in communication with the audio output device, or a combination of the audio output device and the app. In aspects, the personal user device transmits processed data or the determined user activity to the audio output device.

At 204, the audio output device detects an orientation of the head of the user is one of upward or downward using the at least one sensor. The user may orient their head in an upward direction or a downward direction. In an example, signals collected using an accelerometer on the head-mounted audio output device are used to detected head orientation. The accelerometer determines the user's head orientation with respect to gravity. In another example, a magnetometer of an IMU detects the user's head orientation with respect to the north and south cardinal directions. In aspects, a gyroscope of an IMU measures motion of the user's head. In an example, the gyroscope measures rotational motion of the user's head or is used to determine the user is shaking or nodding their head. In aspects, outputs from multiple sensors are combined to determined, with increased accuracy, the orientation of the user's head. The algorithm used to determine the user's head orientation is executed on the audio output device, an app executed on a personal user device in communication with the audio output device, or a combination of the audio output device and the app. In aspects, the personal user device transmits processed data or the determined head orientation to the audio output device.

The user may have their head oriented downward when looking at a keyboard, their personal user device, or the ground. The user may have their heard oriented in an upward direction while looking straight ahead or making eye contact with another person. A downward head orientation or upwards head orientation may be different for each person. For example, people may hold their cell phones at different angles. In aspects, an app running on the user's cell phone (or personal user deice) allows the user to customize the angle of a downward head orientation and the angle of an upwards head orientation. The user may move their head upward and downward and the app may learn about the user's anatomy and head movement.

At 206, the audio output device controls at least one of a level of attenuation applied to the external noise or the audio output based on the detected user activity and the detected orientation of the head of the user. In one example, the audio output device transitions to a transparent mode based on the user activity and user's head orientation. In a transparent (aware) mode, noise canceling and/or noise masking features are decreased or turned off to increase situational awareness. The audio output device operates in a full transparent mode when all noise canceling and noise masking features are turned off so that the user hears external noises as though they are not wearing the device. Feedforward filters on the device and feedforward coefficients are adjusted to provide varying levels of transparency. Examples of controlling the audio output comprises adjusting the volume of audio output played by the device, changing a feature of the audio stream, or changing a type of audio that output by the device.

In aspects, a user configures preferences for how the device controls the level of attenuation applied to the external noise or the audio output based on the detected user activity and the detected orientation of the user's head. A user may enter preferences via an app on their personal user device or directly on the audio output device. In an example, the user typically works or engages in tasks requiring focus while sitting down and orientating their head downwards, for example to look at a computer screen or a desk. A user prefers to hear classical instrumental music at a specific volume while working. Therefore, the user may enter their preference via the app or directly on the audio output device. In another example, the user prefers to have complete transparency when walking with their head is oriented downward. The user may assume that by positioning their head downward, for example, at their phone, they may benefit from increased situational awareness. Therefore, they may program the device to enter a complete transparency mode when walking and having their head oriented downward.

In aspects, the methods described herein are combined with the customized audio experiences described in U.S. patent application Ser. No. 16/788,974 entitled "METHODS AND SYSTEMS FOR GENERATING CUSTOMIZED AUDIO EXPERIENCES," filed on Feb. 12, 2020. As described in U.S. patent application Ser. No. 16/788,97, each activity is defined by a set of configured behaviors. In aspects, activities are further defined to take action to control a level of attenuation to be applied and/or a type of audio adjustment based on the user's activity and head orientation.

The following paragraph provides examples of how behaviors are set based on an activity in accordance with aspects of the present disclosure. Based on the selected audio mode, determined user activity, and head orientation, the audio output device takes action to control the device. During an "exercise activity," when the user is one of walking, running, or engaging in a repetitive movement, and the user's head is oriented downward, the user may configure the device to enable a moderate level of noise cancellation and/or output a type of music with a specific rhythm at a defined volume. During a "work activity," when the user is determined to be sitting down and their head is oriented downwards, the user may save preferences to have complete noise cancelling enabled. During a "commute activity," when the user is determined to be walking and their head is oriented downward, the user may configured to device to implement an incremental amount of noise cancelling and stop all streaming of audio. In the "commute activity," when the user is determined to be on a train and their head is oriented downward, the user may configure the device to increase the amount of noise cancelling and/or stream a pod cast.

Referring back to FIG. 2, in an example use case, a user is seated at work and wearing headphones 110 with noise canceling turned on. Using signals collected from at least one sensor on the headphones, it is determined that the user is sitting down and their head is oriented downwards. Based on configured preferences or an audio mode, when the user stands up and moves their head in an upward direction, the headphones enter a transparent mode. The transparent mode may be a fully transparent mode or a mode in which noise canceling and/or noise masking is reduced relative to when the user was sitting down and with their head oriented downward. With increased situational awareness, the user may not have to remove their headphones when they speak to a colleague.

Next, the user begins walking towards a breakroom. Sensor data is processed to determine the user is now walking and their head is oriented slightly upwards in the direction of travel. In response, the headphones may further decrease the level of noise cancellation and/or noise masking, or decrease a volume of any audio output streaming to the user. Because the user is walking, they may benefit from being more aware of their surroundings by hearing more of the external noise in their environment.

When the user returns to their desk, sits down, and orients their head downwards towards their desk, the headphones transition to a less transparent mode by increasing the level of attenuation applied to the external noise. As the user is likely working, they prefer an increased amount noise canceling or noise masking. In aspects, based on user-specified preferences, the headphones may output classical music at a specific volume in response to determining the user is sitting down and their head is oriented downwards.

In another example use case, the user is walking and their head is oriented downwards. The user may be looking at their personal user device. Consequently, they may be less aware of their surroundings. The headphones may be configured to stop all noise cancelling and decrease the volume or stop the streaming of any audio. Allowing the user to be more aware of their surroundings may increase the user's safety without the user needed to remove the headphones or manually adjust a setting on the headphones or personal user device. When the user is determined to be walking with their head oriented upwards, the headphones may increase the level of noise cancellation by an increment, such that the headphones are not operating in a fully transparent mode or a maximum noise cancelling mode.

Activity-based transparency allows the user to have increased situational awareness based on the user's activity and head orientation. Furthermore, activity-based transparency automatically adjusts the reproduction of external noise and/or audio output based without real-time manual inputs to adjust settings on the audio output device or the user's personal device. In addition to creating a more seamless user experience, activity-based transparency reinforces the notion that headphones are becoming "smart" (for example, more intelligent due to computing power and connection to the Internet).

Aspects describe controlling a level of attenuation applied and/or the audio output based on detected user activity and detected orientation of the head of the user; however, control of the level of attenuation and/or control of the audio output may be based on any combination of head orientation, head motion, and user activity. It may be noted that the processing related to the automatic ANR, ANC, and CNC control as discussed in aspects of the present disclosure may be performed natively in the headphones, by the personal user device, or a combination thereof.

Descriptions of aspects of the present disclosure are presented above for purposes of illustration, but aspects of the present disclosure are not intended to be limited to any of the disclosed aspects. Many modifications and variations will be apparent to those of ordinary skill in the art without departing from the scope and spirit of the described aspects.

In the preceding, reference is made to aspects presented in this disclosure. However, the scope of the present disclosure is not limited to specific described aspects. Aspects of the present disclosure can take the form of an entirely hardware embodiment, an entirely software embodiment (including firmware, resident software, micro-code, etc.) or an embodiment combining software and hardware aspects that can all generally be referred to herein as a "component," "circuit," "module" or "system." Furthermore, aspects of the present disclosure can take the form of a computer program product embodied in one or more computer readable medium(s) having computer readable program code embodied thereon.

Any combination of one or more computer readable medium(s) can be utilized. The computer readable medium can be a computer readable signal medium or a computer readable storage medium. A computer readable storage medium can be, for example, but not limited to, an electronic, magnetic, optical, electromagnetic, infrared, or semiconductor system, apparatus, or device, or any suitable combination of the foregoing. More specific examples a computer readable storage medium include: an electrical connection having one or more wires, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the current context, a computer readable storage medium can be any tangible medium that can contain, or store a program.

The flowchart and block diagrams in the Figures illustrate the architecture, functionality and operation of possible implementations of systems, methods and computer program products according to various aspects. In this regard, each block in the flowchart or block diagrams can represent a module, segment or portion of code, which comprises one or more executable instructions for implementing the specified logical function(s). In some alternative implementations the functions noted in the block can occur out of the order noted in the figures. For example, two blocks shown in succession can, in fact, be executed substantially concurrently, or the blocks can sometimes be executed in the reverse order, depending upon the functionality involved. Each block of the block diagrams and/or flowchart illustrations, and combinations of blocks in the block diagrams and/or flowchart illustrations can be implemented by special-purpose hardware-based systems that perform the specified functions or acts, or combinations of special purpose hardware and computer instructions.

What is claimed is:

1. A method performed by a head-mounted wearable audio output device, comprising at least one sensor, that is worn on a head of a user for controlling reproduction of external noise or audio output, comprising:

detecting a user activity based on motion of the user's body using the at least one sensor;

detecting, with the detected user activity, an orientation of the head of the user is one of upward or downward using the at least one sensor; and controlling at least one of: an incremental level of attenuation applied to the external noise such that the external noise is incrementally attenuated between a fully transparent mode and a maximum noise cancelling mode or the audio output based on the detected user activity and the detected orientation of the head of the user.

2. The method of claim 1, wherein detecting the user activity comprises:

detecting a change from a first detected activity of a set of activities to a second detected activity of the set of activities, wherein the set of activities comprises any combination of: walking, running, sitting, standing, or moving in a mode of transport.

3. The method of claim 2, wherein:

the at least one sensor comprises an accelerometer, and detecting the user activity comprises one of:

detecting the user activity based on energy levels of signals detected by the accelerometer, or detecting the user activity based on a classifier model trained using training data of known accelerometer signals associated with each activity in the set of activities.

4. The method of claim 2, wherein:

detecting the change comprises determining the user changes from sitting to walking; and the controlling comprises reducing the incremental level of attenuation to enable the user to hear more of the external noise.

5. The method of claim 4, further comprising:

determining the user changes from walking to back to sitting; and increasing the incremental level of attenuation to attenuate an increased amount of the external noise.

6. The method of claim 5, wherein increasing the incremental level of attenuation is based on input from the user.

7. The method of claim 1, wherein:

the user activity comprises one of walking or running, the orientation of the head comprises the downward orientation, and the controlling comprises reducing the incremental level of attenuation applied to the reproduction of external noise or adjusting the audio output by lowering a volume of the audio output.

8. The method of claim 1, further comprising:

determining an audio mode, wherein each audio mode of a set of audio modes invokes a set of behaviors by the wearable audio output device, wherein the controlling is further based on the determined audio mode.

9. The method of claim 1, wherein the wearable audio output device is configured to perform Active Noise Reduction (ANR).

10. The method of claim 1, wherein detecting the orientation of the head of the user comprises detecting the head orientation based on learned angles of upward and downward head orientations specific to the user.

11. The method of claim 1, further comprising:

detecting, with the detected user activity, a motion of the head of the user; and wherein controlling at least one of: the incremental level of attenuation applied to the external noise such that the external noise is incrementally attenuated between the fully transparent mode and the maximum noise cancelling mode or the audio output is further based on the detected motion of the head of the user.

12. A head-mounted wearable audio output device for controlling reproduction of external noise or audio output, comprising:

at least one sensor on the wearable audio output device; and at least one processor coupled to the at least one sensor, the at least one processor configured to:

detect a user activity based on motion of the user's body using the at least one sensor when the wearable audio output device is worn on a head of a user;

detect, with the detected user activity, an orientation of the head of the user is one of upward or downward using the at least one sensor; and control at least one of: an incremental level of attenuation applied to the external noise such that the external noise is incrementally attenuated between a fully transparent mode and a maximum noise cancelling mode or the audio output based on the detected user activity and the detected orientation of the head of the user.

13. The head-mounted wearable audio output device of claim 12, wherein the at least one processor detects the user activity by:

detecting a change from a first detected activity of a set of activities to a second detected activity of the set of activities, wherein the set of activities comprises any combination of: walking, running, sitting, standing, or moving in a mode of transport.

14. The head-mounted wearable audio output device of claim 13, wherein:

detecting the change comprises determining the user changes from sitting to walking; and the at least one processor controls by reducing the incremental level of attenuation to enable the user to hear more of the external noise.

15. The head-mounted wearable audio output device of claim 14, wherein the at least one processor is further configured to:

determine the user changes from walking to back to sitting; and increase the incremental level of attenuation to attenuate an increased amount of the external noise.

16. The head-mounted wearable audio output device of claim 15, wherein the at least one processor increases the incremental level of attenuation based on input from the user.

17. The head-mounted wearable audio output device of claim 12, wherein:

the user activity comprises one of walking or running, the orientation of the head comprises the downward orientation, and the at least one processor controls by reducing the incremental level of attenuation applied to the external noise or adjusting the audio output by lowering a volume of the audio output.

18. The head-mounted wearable audio output device of claim 12, wherein the at least one processor is further configured to:

determine an audio mode, wherein each audio mode of a set of audio modes invokes a set of behaviors by the head-mounted wearable audio output device, wherein the at least one processor controls based on the determined audio mode.

19. A head-mounted wearable audio output device worn by a user for controlling reproduction of external noise or audio output, comprising:

an accelerometer;

at least one acoustic transducer for outputting audio; and at least one processor configured to:

detect a user activity based on motion of the user's body using the accelerometer when the wearable audio output device is worn on a head of the user;

detect, with the detected user activity, an orientation of the head of the user is one of upward or downward using the accelerometer; and control at least one of: an incremental level of attenuation applied to the external noise such that the external noise is incrementally attenuated between a fully transparent mode and a maximum noise cancelling mode or the audio output based on the detected user activity and the detected orientation of the head of the user.

20. The head-mounted wearable audio output device of claim 19, further comprising:

noise masking circuitry for generating masking sounds, wherein the at least one processor is configured to adjust the audio output by adjusting one of a content or volume of noise masking based on the detected user activity and the detected orientation of the head of the user.

21. The head-mounted wearable audio output device of claim 19, wherein:

the at least one processor detects the user activity by detecting a change from a first detected activity of a set of activities to a second detected activity of the set of activities, wherein the set of activities comprises any combination of: walking, running, sitting, standing, or moving in a mode of transport, wherein detecting the change comprises determining the user changes from sitting to walking; and the at least one processor controls by reducing the incremental level of attenuation to enable the user to hear more of the external noise.

22. The head-mounted wearable audio output device of claim 19, wherein the at least one processor is further configured to:

determine an audio mode, wherein each audio mode of a set of audio modes invokes a set of behaviors by the head-mounted wearable audio output device, wherein the at least one processor controls based on the determined audio mode.

* * * * *